US005957358A

United States Patent [19]

Getz et al.

[11] Patent Number: 5,957,358

[45] Date of Patent: Sep. 28, 1999

[54] BATTERY STRIP DISPENSER

[75] Inventors: Rose A. Getz, Westlake; Lewis F. Urry, Elyria, both of Ohio

[73] Assignee: Eveready Battery Company, Inc., St. Louis, Mo.

[21] Appl. No.: 08/970,275

[22] Filed: Nov. 14, 1997

[51] Int. Cl.[6] ..... B26F 3/02

[52] U.S. Cl. ..... 225/77; 225/34; 206/820

[58] Field of Search ..... 225/2, 34, 38, 225/42, 39; 206/394, 461, 705, 820

[56] References Cited

U.S. PATENT DOCUMENTS

| | | | |
|---|---|---|---|
| 4,328,184 | 5/1982 | Kondo | 206/820 |
| 4,450,959 | 5/1984 | Sommer | 206/461 |
| 4,527,722 | 7/1985 | Strachan | 225/34 |
| 4,567,986 | 2/1986 | Eastwood | 206/820 |
| 4,702,563 | 10/1987 | Parker . | |
| 4,804,984 | 2/1989 | Heuer et al. | 206/461 |
| 4,958,731 | 9/1990 | Calcerano | 206/705 |
| 5,188,231 | 2/1993 | Kivell et al. . | |
| 5,223,003 | 6/1993 | Tucholski et al. . | |
| 5,494,204 | 2/1996 | Wang | 225/38 |

*Primary Examiner*—Rinaldi I. Rada
*Assistant Examiner*—Gyounghyun Bae
*Attorney, Agent, or Firm*—Robert W. Welsh; S. Allan Fraser

[57] ABSTRACT

A battery strip dispenser for dispensing user-selectable combinations of batteries to consumers. The battery strip dispenser includes a dispensing mechanism for holding batteries, and further includes a battery strip containing a plurality of batteries packaged in flexible packaging material. The battery strip includes a plurality of packages, each containing a battery, and has perforations formed in the packaging material between adjacent packaged batteries. The battery strip can be dispensed from the dispensing mechanism, and packaged batteries can be separated from other batteries in the battery strip by tearing at the perforations to separate a desired number of batteries.

20 Claims, 3 Drawing Sheets

BATTERY STRIP DISPENSER

BACKGROUND OF THE INVENTION

The present invention generally relates to battery packaging and, more particularly, to an apparatus for dispensing packaged batteries to consumers.

Electrochemical cells, also commonly referred to as batteries, are widely employed to supply voltage for various types of electrically operated devices, particularly for widespread use in portable electrically operated devices. Batteries are commercially available in industry-recognized standard shapes and sizes, including D-, C-, AA-, AAA-, and AAAA-size cylindrical, single-cell alkaline batteries. Batteries of the same size are usually made available to consumers for purchase in a package containing a predetermined number of batteries. Currently, batteries are displayed and sold in blister packs which contain two, four, or eight batteries commonly packaged in each blister pack. The blister pack generally contains a blister of plastic into which a predetermined number of batteries are disposed and the blister sealed to a paper card. Additionally, each blister pack typically has a loop so that the package can be hung on a hook on a plastic or wire display stand in a retail store for display and purchase by a consumer.

According to known conventional packaging arrangements, the consumer is typically required to purchase a predetermined number of batteries as made available in each package, despite the consumer's desire to purchase a different number of batteries. For example, a consumer needing only three batteries is typically required to purchase four batteries, since a battery package of three batteries is usually not available. As a consequence, the consumer has to purchase an extra battery which may not be used for a long period of time, and potentially may never be used, thereby resulting in wasted expenditure and energy. In addition, the conventional battery packages usually require a relatively large amount of space to hang the individual packages for display and purchase by consumers.

It is a primary concern to distribute batteries for display and purchase in a package that protects the batteries from premature discharge and keeps out moisture which could cause corrosion and damage, and yet consuming a minimal amount of space. Accordingly, it is therefore desirable to provide for a battery packaging arrangement that makes available to the consumer the ability to purchase various combinations of batteries. It is further desirable to provide such a means for dispensing batteries for purchase by a consumer while efficiently utilizing the available amount of space.

SUMMARY OF THE INVENTION

The present invention provides flexibility to the consumer so as to allow for the purchase of various user-selectable combinations of batteries, while efficiently utilizing space available to distribute and display batteries made available for purchase. To achieve this and other advantages, and in accordance with the purpose of the present invention as embodied and described herein, the present invention provides a battery strip dispenser for dispensing batteries in user-selectable numbers. The battery strip dispenser includes a dispensing mechanism and a battery packaging strip containing a plurality of batteries preferably packaged in flexible packaging material. The battery packaging strip includes a plurality of connected packages each containing a battery and has perforations formed in the packaging material between adjacent battery packages. The battery strip is provided in the dispensing mechanism and is easily dispensed from the dispensing mechanism by a consumer. The packaged batteries can be separated apart from other batteries in the strip in user-selected numbers by tearing off the desired number of batteries from the strip at the perforations.

These and other features, objects, and benefits of the invention will be recognized by those who practice the invention and by those skilled in the art, from reading the following specification and claims, together with reference to the accompanying drawings.

DETAILED DESCRIPTION OF THE PREFERRED EMBODIMENTS

Figure 1:
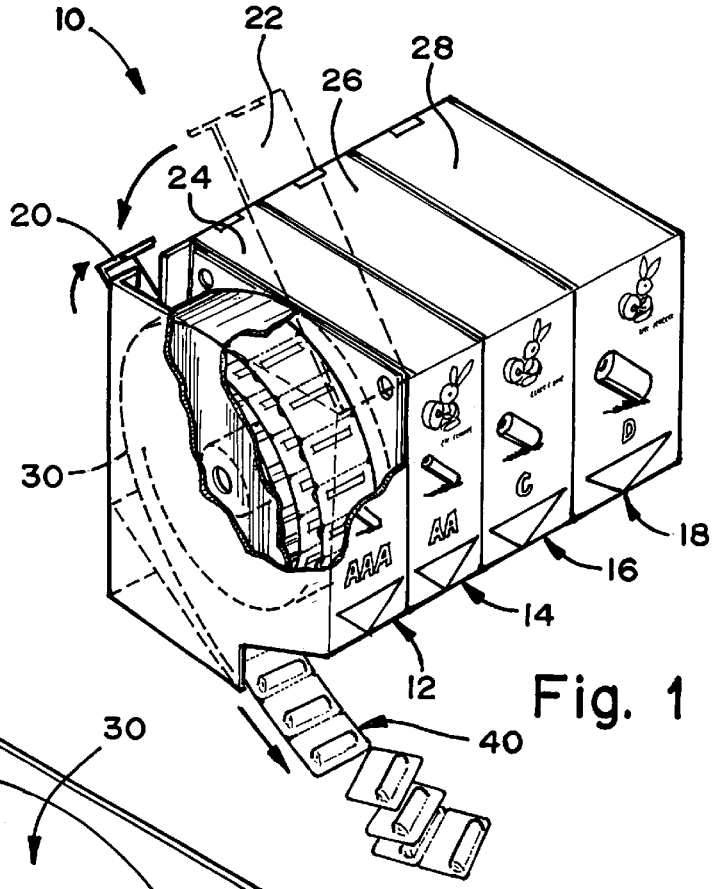
FIG. 1 is a schematic diagram of a battery strip dispensing apparatus for dispensing batteries in accordance with the present invention.

Referring now to FIG. 1, a battery strip dispensing apparatus 10 is illustrated, which is particularly useful for display and easy dispensing of batteries in a retail store or a vending machine. The battery strip dispensing apparatus 10 as shown therein includes four individual battery dispensing units 12, 14, 16, and 18, all housed within a common housing of apparatus 10. Battery dispensing unit 12 preferably contains and dispenses one dedicated-type and size of battery, such as the standard cylindrical alkaline AAA-size battery, which is well-known throughout the industry. Likewise, battery dispensing units 14, 16, and 18 may contain and dispense other size batteries, such as the industry recognized standard cylindrical alkaline AA-, C-, and D-size batteries, respectively. Although a four-unit battery dispensing apparatus 10 is shown and described herein, in accordance with dispensing AAA-, AA-, C-, and D-size alkaline batteries, it should be appreciated that the teachings of the present invention are not intended to be limited to the embodiments shown.

The battery strip dispensing apparatus 10 includes a generally rectangular container housing each of the individual battery dispensing units 12, 14, 16, and 18, with dispensing units 12, 14, 16, and 18 having corresponding covers 22, 24, 26, and 28, respectively. Each of covers 22, 24, 26, and 28 pivots at one end and is fastened via a fastener means, such as a latch 20, at the other end, as shown with respect to cover 22. Accordingly, each cover, such as cover 22, may be opened to allow access to a roll dispenser 30 housed within the corresponding dispensing unit. Easy access via covers 22, 24, 26, and 28 enables a battery supplier, such as a battery manufacturer, distributor, or retail sales stock person, to easily replenish the supply of batteries to each of the battery dispensing units. It should also be appreciated that the covers 22, 24, 26, and 28 may include a locking mechanism to limit access to the inside of dispensing apparatus 10 to authorized personnel only.

Figure 2:
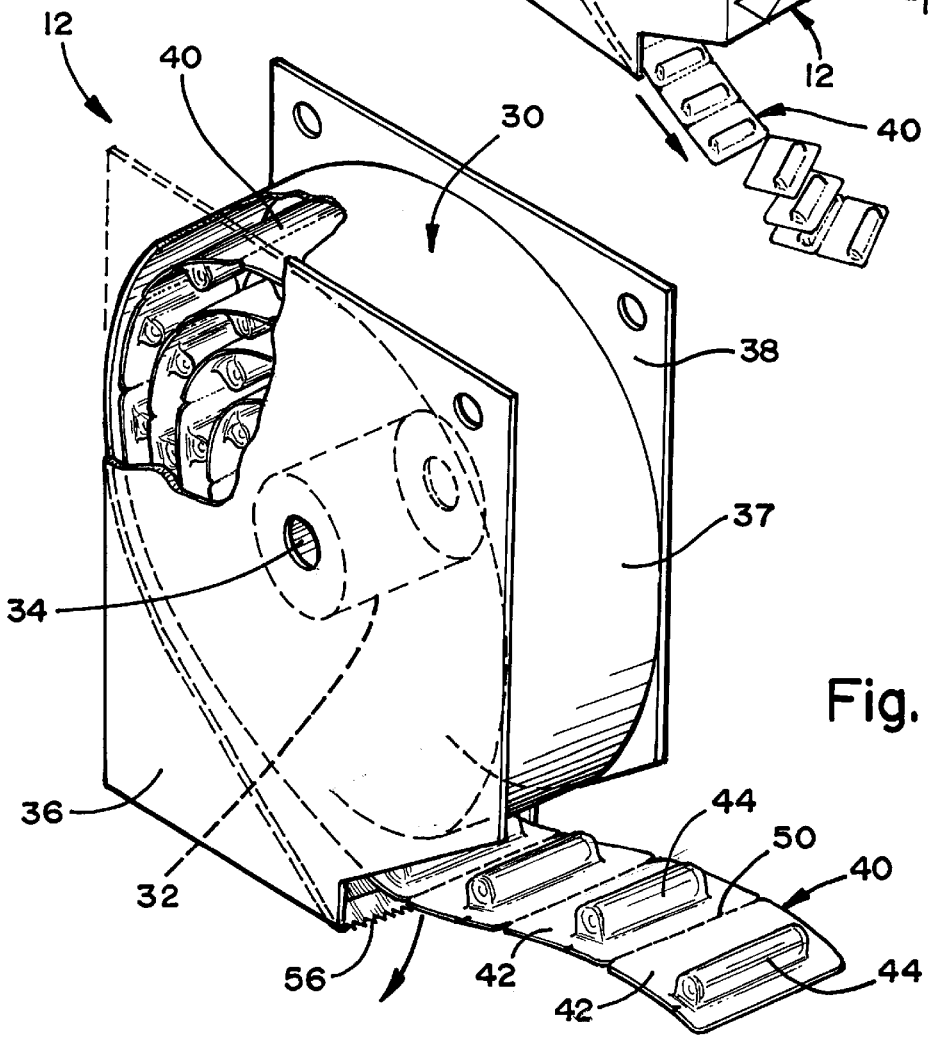
FIG. 2 is an enlarged view of one battery dispensing unit of the battery strip dispensing apparatus of FIG. 1.
Figure 3:
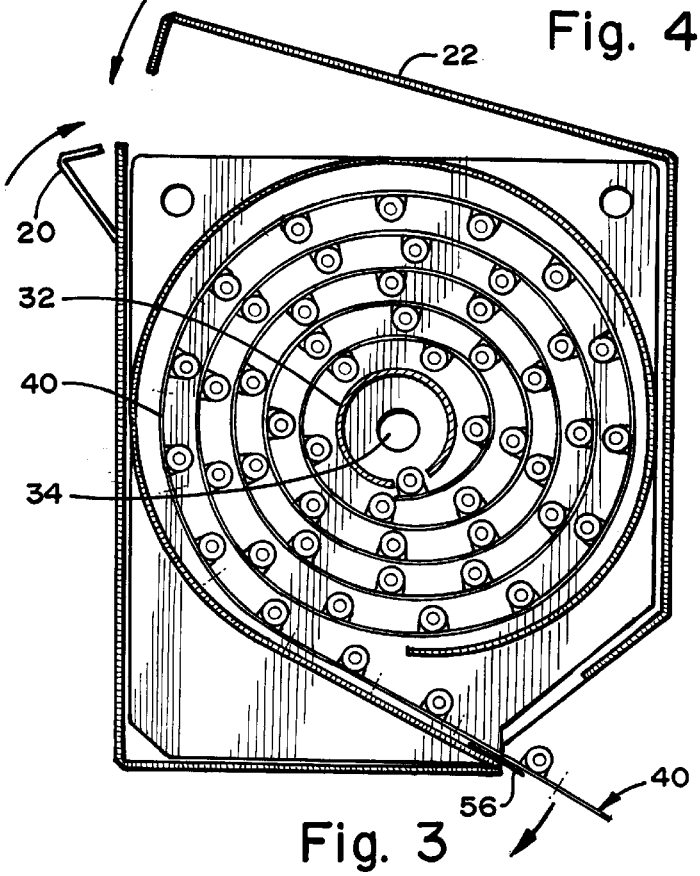
FIG. 3 is a cross-sectional view of the battery dispensing unit taken through lines just inside the side wall.

Referring to FIGS. 2 and 3, one dispensing unit 12 and its corresponding roll dispenser 30 are shown in greater detail having parallel sidewalls 36 and 38 provided on opposite sides, and an outer radial cover 37. The roll dispenser 30 has an inner cylindrical roller 32 which has a central cylindrical opening 34 for matingly engaging an axle (not shown) such that roller 32 is rotatable about the axle. As particularly shown in FIG. 3, a battery packaging strip 40 is wound around roller 32 repeatedly to provide multiple overlapping layers of batteries in a spiralwound arrangement. The roll dispenser 30 has an outlet passage provided in outer radial cover 37 that allows an outer extending tongue portion of battery packaging strip 40 to extend therefrom. The dispensing unit further includes a tear edge 56 extending out from below the outlet passage for aiding in tearing apart adjacent battery packages at the dividing perforation. In operation, a user, such as a consumer, may grab hold of the outer-extending tongue portion of battery packaging strip 40 and pull it so as to unroll the battery packaging strip 40 from roller 32 to thereby dispense batteries from the battery dispensing unit. The user may then tear off a selected number of batteries with the corresponding individual battery packages 42 by separating the battery packages 42 from the battery packaging strip 40, preferably at the desired dividing perforation 50.

Figure 4:
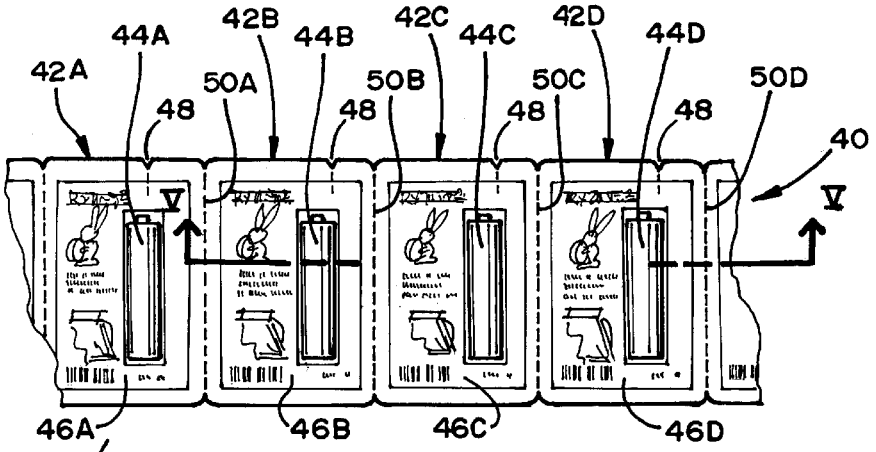
FIG. 4 is an enlarged partial view of the battery packaging strip containing individually packaged batteries according to the present invention.

With particular reference to FIG. 4, the battery packaging strip 40 is shown in greater detail to include a plurality of series connected individual battery packages 42A, 42B, 42C, etc. Each of the individual battery packages, such as battery package 42A, preferably includes one individually packaged battery, such as battery 44A, packaged with a thin layer of plastic on the top and bottom sides which effectively seals the packaged battery from moisture and prevents premature discharge caused by contact with conductive surfaces. A thin paper layer is disposed in the plastic layers and around the sides of the battery. The thin paper layer may include battery manufacture and use information relating to the battery, as should be evident in the art. In addition, a weakened package portion, such as notch 48A with perforations, is provided in each of the individual packages at a tear location so as to provide a weakened point to allow a user, such as a consumer, to easily open the individual package 42A to remove the battery 44A from its packaging materials.

Figure 5:
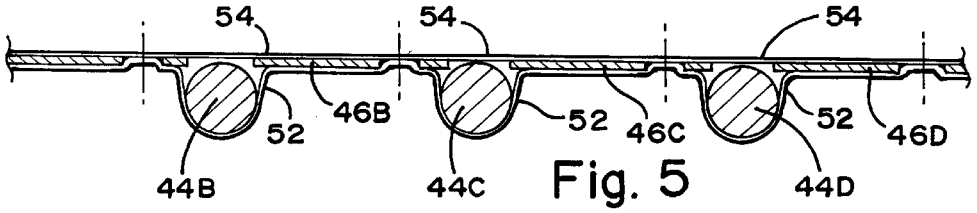
FIG. 5 is a cross-sectional view of the battery packaging strip taken through lines V—V of FIG. 3.

As shown more closely in FIG. 5, the battery packaging strip 40 has a first layer of thin plastic 54 provided on one side of the individual batteries 44B–44D. According to one embodiment, plastic layer 54 provides a substantially flat planar surface that flexes as the battery packaging strip 40 is rolled and unrolled. A second thin layer of plastic 52 is provided on the opposite side of batteries 44A–44D, and wraps around a substantial portion of the batteries. The thin paper layer 46B, 46C, and 46D is disposed between the thin plastic layers 54 and 52 and, according to the embodiment shown, has an opening into which the battery is disposed. It should be appreciated that plastic layers 52 and 54, as well as paper layer 46, flex as the battery packaging strip 40 is rolled and unrolled. If desired, the packaging strip 40 can be provided without the paper layer 46 to facilitate recycling of the packaging materials. Alternately, other types of materials could be used to facilitate recycling of the packaged materials.

Figure 6:
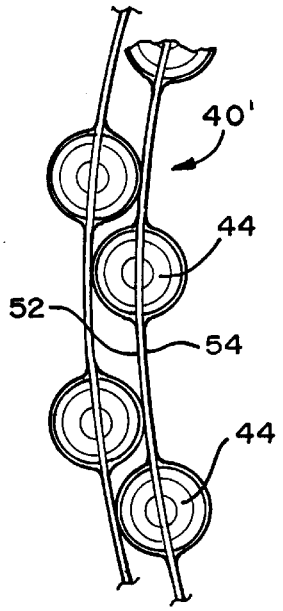
FIG. 6 is a side view of a battery packaging strip according to an alternate embodiment of the present invention.

According to a second embodiment shown in FIG. 6, the battery packaging strip 40' may be provided with the batteries 44 disposed centrally between the thin plastic layers 52 and 54. According to this embodiment, plastic layer 52 provides a semi-cylindrical covering over approximately one-half of each battery 44, while the other thin plastic layer 54 likewise provides to a thin, semi-cylindrical cover over approximately the other one-half of each battery 44. According to this arrangement, the battery packaging strip 40' may be wrapped in multiple, overlapping layers, around roller 32, so that the batteries 44 compactly conform to allow maximum utilization of volume available within the battery roll dispenser 30. In doing so, batteries 44 on adjacent layers of battery packaging strip 40' are serially offset from adjacent batteries in adjacent portions of the strip, and thus conform in place such that a battery on one layer is disposed between two batteries on an adjacent layer so as to maximize volume utilization.

Figure 7B:
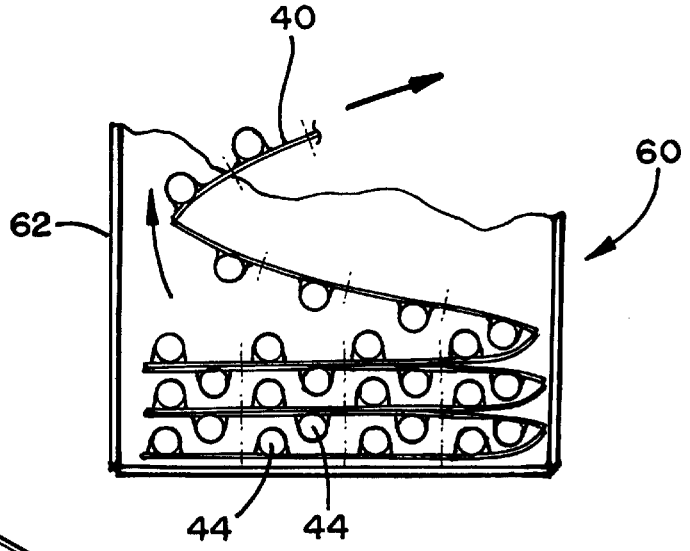
FIGS. 7*a* and 7*b* are views of a battery dispensing unit having the battery packaging strip housed in a folded, overlapping arrangement, according to an alternate embodiment.
Figure 7A:
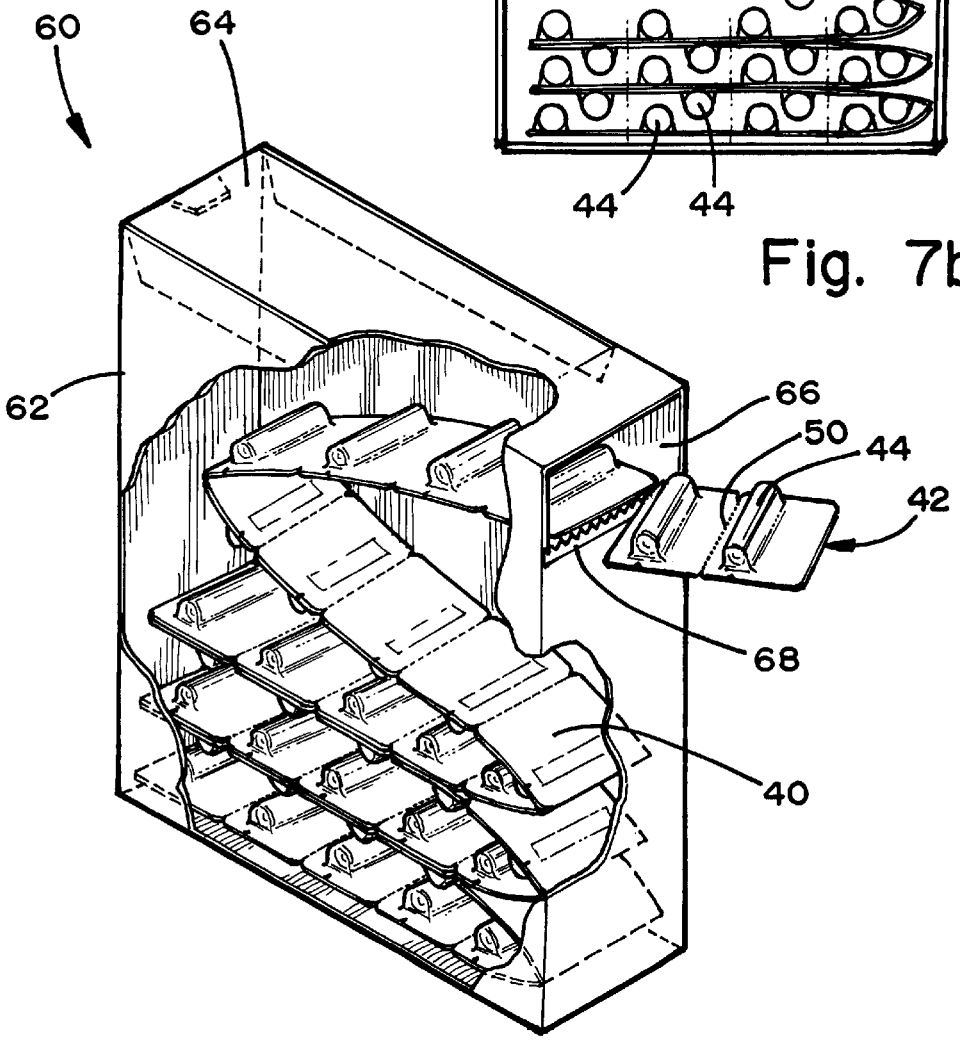

Referring to FIGS. 7*a* and 7*b*, an alternate dispensing unit 60 is shown, provided without a roll dispensing mechanism, and instead having a rectangular volume within which the battery packaging strip 40 is folded back and forth in a folded, overlapping arrangement. According to this embodiment, the dispensing unit 60 includes a generally rectangular housing 62 having an openable cover 64 and a battery outlet passage 66. The battery packaging strip 40 is generally housed within rectangular housing 62 and has one end extending through outlet passage 66. A tear edge 68 is provided along the bottom edge of outlet passage 66 to allow a consumer to tear apart adjoining battery cell packages 42 along the selected perforation 50. It should be appreciated that dispensing unit 60 houses battery packaging strip 40 such that battery packaging strip 40 overlaps in a folded manner, preferably with the flat sides of battery packaging strip 40 adjacent and abutting each other, and with the batteries 44 on the other side preferably interposed between adjacent batteries 44 on the abutting adjacent layer. Accordingly, the user may easily pull the outer extending tongue portion of battery packaging strip 40 extending out of cutlet passage 66 to remove a length of battery packaging strip 40 and tear apart a desired number of battery packages 42, preferably along a perforation and with the use of tear edge 68.

Accordingly, the battery dispenser 10 of the present invention enables, a consumer to easily dispense and purchase a user-selectable number of batteries 44 as are so needed. In addition, the batteries 44 are contained in a packaging strip 40 that is housed in a compact, easy to use dispensing mechanism. At the same time, the batteries remain sealed individually to prevent moisture from entering the package and preventing premature battery discharge and other damage to the batteries. Further, the individual roll dispensers 30 may be easily changed or refilled with a new supply of batteries to achieve rapid changeover for retailers offering the batteries for sale.

To further aid in the dispensing of batteries, the battery dispensing units may further include additional means for aiding in unrolling and dispensing the battery packaging strip 40. According to one embodiment, a rotary handle could be attached to roller 32 so as to allow a potential customer to actuate the handle to rotate the roller so as to aid in battery strip dispensing. According to another embodiment, the dispensing unit 30 could be equipped with an electric motor accompanied with a controller, such as a processor-based controller, and user input interface. With this embodiment, a potential customer can input the desired number of batteries via the user input interface, while the processor or other control device controls, the motor such that the motor rotates the roller 32 so as to dispense the programmed number of batteries. With this approach, a user-selectable number of batteries can be dispensed, and thereafter a single price tag or scanning code can be attached to the user-selected group of dispensed batteries.

While the battery dispensing apparatus has been shown and described herein with dispensing units for dispensing individually packaged batteries, it should be appreciated that various combinations of batteries could be packaged together within the individual battery packages. This would enable a consumer to select for dispensing a selectable number of groups of commonly packaged batteries. Additionally, each packaging unit or certain packaging units could include battery accessories, such as a battery tester commonly packaged with a battery within a battery package. Examples of battery testers are disclosed in issued U.S. Pat. Nos. 4,702,563 and 5,188,231, both of which are hereby incorporated by reference. Each battery 44 could also contain a battery testing strip on the battery, such as provided on the label. One example of such a battery testing strip contained on the battery label is disclosed in issued U.S. Pat. No. 5,223,003 to Tucholski et al., entitled Process for Preparing a Battery Tester Label, and which is also hereby incorporated by reference. The thin plastic layers 52 and 54 surrounding each battery may easily flex, thereby allowing a potential customer to depress the battery tester strip button on the label to check if that particular battery is fresh. This is particularly useful to customers who are deciding whether to purchase that particular battery. Further, other accessories which may be packaged with the batteries may include an electronic article surveillance device.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The embodiments of the invention in which an exclusive property or privilege is claimed are defined as follows:

1. A battery dispensing apparatus comprising:

a dispensing mechanism for dispensing batteries, wherein said dispensing mechanism includes a roll feeder mounted on an axle; and a battery strip containing a plurality of batteries packaged in flexible packaging material, said battery strip including a plurality of connected packages each containing a battery and further including separation means provided between adjacent packages such that said battery packages can be separated from said battery strip, wherein said battery strip is overlappingly rolled on said roll feeder.

2. The battery dispensing apparatus as defined in claim 1, wherein said separation means comprises perforations formed in said packaging material.

3. The battery dispensing apparatus as defined in claim 2, wherein said dispensing mechanism comprises a housing and a tear edge for causing said perforations to tear when forcibly applied thereto.

4. The battery dispensing apparatus as defined in claim 1, wherein each of said plurality of packaged batteries is individually packaged.

5. The battery dispensing apparatus as defined in claim 1, wherein said packaging material comprises a bottom layer of flexible packaging material and a top layer of flexible packaging material.

6. The battery dispensing apparatus as defined in claim 5, wherein said top layer of packaging material comprises plastic.

7. A battery dispensing apparatus comprising:

a dispensing mechanism for dispensing batteries, wherein said dispensing mechanism includes a roll feeder mounted on an axle;

a battery strip containing a plurality of batteries packaged in flexible packaging material, said battery strip including a series of connected battery packages each containing at least one battery, wherein said battery strip is overlappingly rolled on said roll feeder; and separation means for separating battery packages from said battery strip without opening individual battery packages, such that a user may select a desired number of batteries.

8. The battery dispensing apparatus as defined in claim 7, wherein said separation means comprises perforations formed in said packaging material.

9. The battery dispensing apparatus as defined in claim 7, wherein said dispensing mechanism comprises a housing and a tear edge for cutting said battery strip when forcibly applied thereto.

10. The battery dispensing apparatus as defined in claim 7, wherein said packaging material comprises a bottom layer of flexible packaging material and a top layer of flexible packaging material.

11. The battery dispensing apparatus as defined in claim 10, further comprising a thin paper layer disposed between said top and bottom layers of flexible packaging material.

12. A battery dispensing apparatus comprising:

a housing;

a roller mechanism; and a battery strip containing a plurality of batteries packaged in flexible packaging material, said battery strip including a plurality of battery packages each containing a battery and perforations provided in said packaging strip between adjacent battery packages such that one or more of said battery packages can be separated from said battery strip, said battery strip being wrapped upon said roller mechanism.

13. The battery dispensing apparatus as defined in claim 12, wherein said dispensing mechanism comprises a housing and an edge for causing said perforations to tear when forcibly applied thereto.

14. A flexible battery strip for use on a roll dispenser for dispensing a selectable number of batteries comprising:

a packaging strip having a plurality of connected packages formed of a flexible packaging material, wherein said packaging strip is flexible so that said packaging strip can be wound and unwound from a roll dispenser;

a battery contained in each of said packages; and separation means formed between adjacent packages such that said packages can be separated from said packaging strip.

15. The battery strip as defined in claim 14, wherein said separation means comprises perforations provided in said packaging strip.

16. The battery strip as defined in claim 14, wherein said battery strip is housed in a dispensing apparatus.

17. A method of dispensing a selectable number of batteries, said method comprising the steps of:

providing a dispensing mechanism having a roll feeder for dispensing batteries;

packaging a plurality of batteries in a flexible packaging material to form a battery strip, including forming a plurality of connected packages, each containing a battery;

providing a tear section between adjacent packages so that adjacent packages can be separated from said battery strip;

holding said battery strip in said dispensing mechanism and wound on said roll feeder; and dispensing a selectable number of batteries from said battery strip, by unrolling said battery strip from said roll feeder.

18. The method as defined in claim 17, wherein said step of forming said battery strip comprises assembling a top layer of flexible packaging material and a bottom layer of flexible packaging material.

19. The method as defined in claim 17, wherein said step of providing a tear section comprises forming perforations in said battery strip.

20. A battery dispensing apparatus comprising:

a dispensing mechanism for dispensing batteries and having a rotatable roller that is rotatable about an axis; and a battery packaging strip containing a plurality of batteries packaged in a flexible packaging material and wound on said rotatable roller and adapted to be unwound from said roller, said battery packaging strip including a plurality of detachable packaging sections each containing a battery, and said battery packaging strip being flexible so that adjacent packaging sections flex relative to one another to allow the battery packaging strip to bend to be wound on and unwound from said roller.

* * * * *